United States Patent [19]

Meriwether

[11] Patent Number: 5,061,022

[45] Date of Patent: Oct. 29, 1991

[54] DOOR CLOSING MECHANISM

[75] Inventor: Jon D. Meriwether, Follansbee, W. Va.

[73] Assignee: The Louis Berkman Company, Steubenville, Ohio

[21] Appl. No.: 535,701

[22] Filed: Jun. 11, 1990

[51] Int. Cl.[5] ..... A47B 88/00

[52] U.S. Cl. ..... 312/324; 49/367; 292/33

[58] Field of Search ..... 312/214, 324; 49/367, 49/368, 369; 292/33, 35, 41

[56] References Cited

U.S. PATENT DOCUMENTS

| | | | |
|---|---|---|---|
| 1,842,998 | 1/1932 | Rebischke et al. | 292/33 X |
| 2,386,495 | 10/1945 | Nieter | 292/33 |
| 3,403,954 | 10/1968 | Williams | 312/351 |
| 4,262,448 | 4/1981 | Flider | 312/214 X |
| 4,949,505 | 8/1990 | Cohrs | 49/361 |

*Primary Examiner*—Joseph Falk

*Attorney, Agent, or Firm*—Body, Vickers & Daniels

[57] ABSTRACT

A door closure arrangement is provided for a paint cabinet or like enclosure containing combustible materials. Right and left hand doors are hinged to door jambs in the cabinet's opening and an overlapping lip is provided on one of the doors to insure that no gap between the doors exists when the doors are closed. Door closures, held in an open position by temperature sensitive fusible links, rotate the doors from an open to a closed position should a fire melt the fusible links. A spring biased, lever actuated door sequencing mechanism insures that the doors closed in proper sequence without interference from the overlapping lip. A spring biased, lever actuated mechanism automatically latches or locks the doors when they are rotated into the closed position whereby the adverse effects of the fire on the contents of the cabinet are minimized.

25 Claims, 10 Drawing Sheets

DOOR CLOSING MECHANISM

This invention relates generally to a door closure mechanism and more specifically to a mechanism which controls the door closing sequence while providing for automatic latching of the doors upon closure.

The invention is particularly applicable and will be described with specific reference to the door closing arrangement for use with cabinets for storing paint and like combustible materials which, upon sensing a fire, automatically close and lock the paint container. The invention, however, has broader application and can be used in any arrangement where two doors must be sequenced when they close an opening where door(s) must automatically lock when they close and preferably the door closure is triggered by the happening of an external event.

BACKGROUND OF THE INVENTION

Paint cabinets have heretofore used automatic door closing mechanisms. A sliding door has been used to close the opening to a paint cabinet. A conventional door closure or actuator is attached to the door to close the cabinet's opening. The door closure is stopped from closing the door by means of a temperature sensitive, fusible link. When a fire occurs, the link melts and the door closure is actuated to slide the door over the opening and thus close the cabinet.

This arrangement works only if the track over which the door slides is clear. If in the process of using the cabinet, a paint container on any of the shelves in the cabinet is pushed or is moved to extend into the path of the track or if an object such as a screwdriver or the like is left protruding out of the shelf, the object can and does wedge itself between the cabinet and the door. This prevents the door from closing and defeats the purpose of the door closing mechanism, i.e. a safety device designed to close and seal the cabinet in the event of a fire and possibly prevent an explosion from the combustible material stored in the cabinet should the fire continue.

A hinge door which rotates from an open to a closed position or two doors which would rotate from open to a closed position would, in all probability, remove the problem of articles lying in the track path of a sliding door to prevent the door from closing. Any articles placed at the edge of the shelf would simply be pushed back into the cabinet when the doors rotated into their closed position. However, the door arrangement must be constructed and sequenced to close in a manner which does not permit any space or opening to exist between the doors to prevent flames from spreading out or into the cabinet. Also, the door must also automatically lock in a positive manner so as to prevent opening thereof in the event of explosion of the combustibles within the cabinet.

SUMMARY OF THE INVENTION

Accordingly, it is a principal object of the invention to provide a hinged door arrangement for use in a paint cabinet and the like which will automatically close and seal the cabinet's opening in the event of a fire.

In accordance with this object an automatic door closing and latching arrangement for a cabinet storing paint and like combustible materials is provided. The cabinet has an opening defined by left hand and right hand vertically extending jambs and top and bottom frame members extending therebetween. The door arrangement includes a first door hinged at one jamb and a second door hinged at the opposite jamb so that the doors are rotatable from a closed position flush with the cabinet to an open position where access to the opening can be had. The second door has a vertically extending lip protruding beyond its vertically extending edge which is opposite to the hinge end to prevent any gap from forming between the doors when they are in a closed position. A door closure mechanism constantly biases both doors to rotate from their open to their closed position and includes a temperature sensing arrangement which holds the doors in their open position against the bias of the door closure and automatically release their hold when a predetermined temperature is sensed. A door sequencing means is then operable to prevent the first door from closing until the second door has closed so that the lip will not prevent the doors from properly closing. A door self-latching mechanism in the first door is operable upon closing of the first door to latch the first door to the top and bottom frame members and to the second door so that both of the doors are securely latched while the lip prevents any flame from entering into or escaping out of the opening between the doors.

In accordance with a specific aspect of the invention, the door sequencing mechanism operates against the biasing force of the door closure mechanism to permit the second door to close always prior to the closing of the first door so that both doors can rotate to their closed position without interference from the lip on the second door. More specifically, a first lever protruding from one of the frame members contacts the first door prior to closure and prevents its rotation into the closed position. A second lever also protrudes from the frame member and is contacted by the second door when the door closure rotates the second door into its closed position. Movement of the second lever causes an actuating link to disengage the first lever from its protruded or locking position to thus permit the door closure on the first door to rotate the first door into its closed position. In accordance with a still more specific feature of the invention, the first and second levers are spring biased into their protruded position and connected to one another by the actuating link which extends transversely to the levers. At one end of the actuating link a pin positively engages a notch at the edge of the first lever to prevent movement of the first lever from its extended or protruded position. The opposite end of the actuating link is pivotally pinned to a bellcrank which in turn is likewise pivotally pinned to the second lever so that movement of the second lever causes the bellcrank to rotate and pull the actuating link pin from the slot in the first lever thus permitting the door closure to rotate the first door to its closed position and in the process thereof move the first lever. In accordance with still more specific features of the invention, the bellcrank provides an efficient mechanism for correlating movement between the first and second levers vis-a-vis the actuating link and the spring bias on the first and second levers automatically return the levers to their protruded position when the doors are moved from their closed to their open position whereby the door sequencing mechanism is automatically readied to function on closing.

In accordance with another feature of the invention, the invention includes a cabinet having left and right hand vertically extending jambs and top and bottom frame members extending between the jambs to define an opening. A door is pivotally mounted to one of the jambs for rotating from a closed position whereat at least a portion of the opening is closed to an opening position whereat access to the cabinet can be had through the opening. Self-latching means are provided for automatically locking the door to the opening when the door is rotated from its open to its closed position. The self-latching mechanism includes a door actuating lever and actuating lever guides permit the actuating lever to move from a locked position when the door is open to an unlocked position when the door is closed. An actuating spring biases the actuating lever to its locked position. A positioning door lever adjacent to and actuated by the door actuating lever is then provided. Positioning lever guides permit the positioning lever to move from a locked position when the door is in its open position to an unlocked position when the door is in its closed position and a positioning lever spring biases the positioning lever to its unlocked position. A door latch mechanism is operably connected to the positioning lever for automatically latching the door to at least one of the frame members when the door, in its closed position, moves the actuating lever to its unlocked position and permits the positioning lever spring to move the positioning lever to its unlocked position. More specifically, the door latch mechanism includes a bellcrank rotatable about a pivot point, an arm extending from the bellcrank and pivotally pinned to the positioning lever so that the bellcrank rotates about its pivot point when the positioning lever moves from one position to another. A top latch rod pivotally pinned on one side of the bellcrank's pivot and a bottom latch rod pivotally pinned to the opposite side of the pivot move the latch rods into and out of locking engagement with the frame members upon rotation of the bellcrank to provide a positive lock. In accordance with a still further feature of the invention, the door has a handle affixed to the pivot of the bellcrank and manually operable to rotate the bellcrank about its pivot against the bias of the positioning lever spring for overriding the positioning lever spring when the door is unlatched and rotated from its closed locked position to its open position even though the door actuating lever remains in its locked position. In accordance with another aspect of the latching arrangement, a locking tongue is provided on the bellcrank which, if a single door closure is used, will latch into the opposing jamb and if a double door arrangement is used as described above, will latch within a slot formed in the vertically extending edge of the adjacent door. In all instances the latching mechanism will provide a three lock point mechanism to positively assure locking of the door. Still yet another important feature of the invention is to affix a dampener to the bellcrank arm pinned to the pivoting lever to provide a time delay in the latching mechanism prior to latching to assure that the door has returned to its closed position by the door sequencing mechanism. This avoids premature actuation of the latching mechanism. Still yet another feature of the invention resides in an adjustment mechanism affixed to the jamb about which the latching door rotates which assures positive engagement and adjustment of the travel of the door actuating lever upon rotation of the latching door.

It is thus a principal object of the invention to provide a two door closure arrangement for an opening in the cabinet and the like which assures that the doors will close in an appropriate sequence.

It is yet another principal object of the invention to provide a door closing arrangement which will automatically and positively lock the door upon door closure.

Still yet another object of the invention is to provide a cabinet with a door sealing arrangement to protect the contents of the cabinet from fire and also to protect the surrounding atmosphere from any fire or explosion which might take place within the cabinet.

Still yet another object of the invention is to provide a simple and economical door closing and latching arrangement for cabinets and similar applications.

These and other objects of the invention will become apparent to those skilled in the art upon a reading and understanding of the Detailed Description of the Invention. which follows.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE INVENTION

Figure 1:
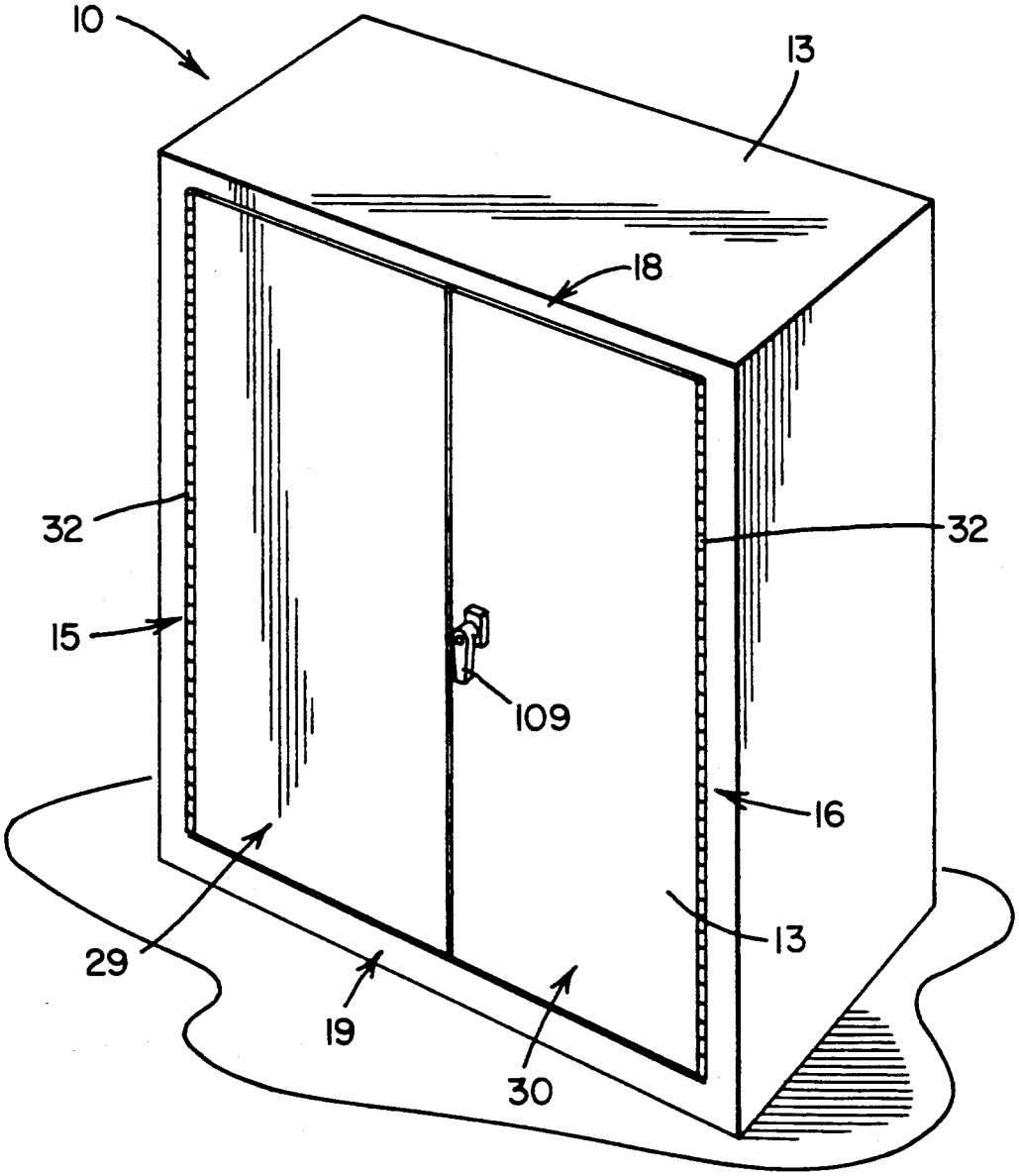
FIG. 1 is a perspective view of a cabinet showing the door arrangement of the present invention in a closed position.
Figure 2:
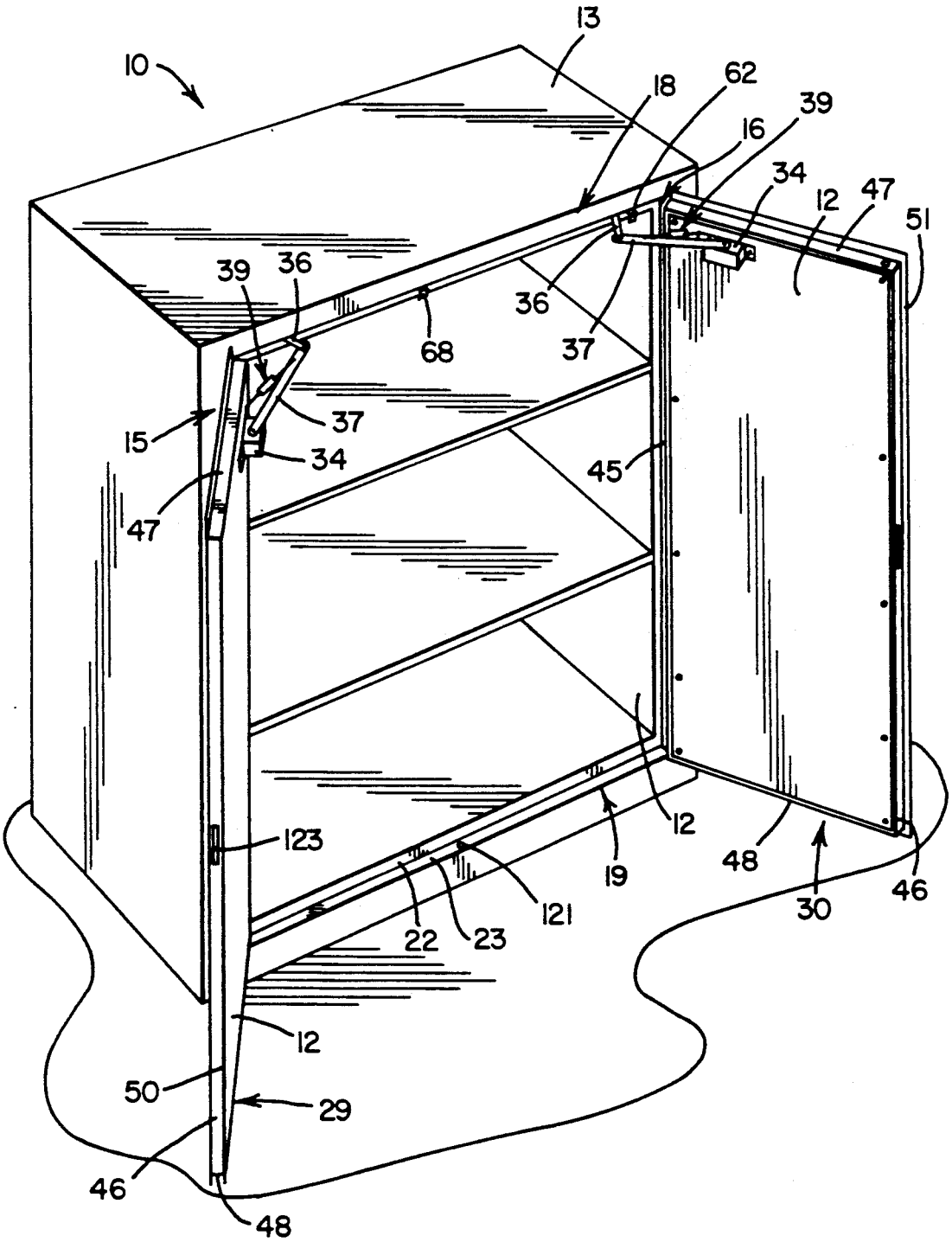
FIG. 2 is a perspective view of the cabinet shown in FIG. 1 with the doors in an open position.

Referring now to the drawings wherein the showings are for the purpose of illustrating a preferred embodiment of the invention only and not for the purpose of limiting the same, there is shown in FIGS. 1 and 2 a cabinet 10, typically for storing solvent based paint or other types of combustible material. It is desirable that combustible material be kept within a safe enclosure which can be automatically sealed in the event of fire originating externally to the enclosure to prevent that material within the enclosure from combusting and possibly exploding thus adding to the severity of the fire. Should the fire originate within the cabinet or the container holding the combustible material, it is necessary that the cabinet or enclosure seal itself to prevent the combustible material from further combusting or exploding obviously leading to a severe fire. Safety regulations contemplate this. Cabinet 10, to be a fire resistant enclosure, is constructed as two sheet metal panels with insulation sandwiched between. Specifically, cabinet 10, including the doors, comprises throughout an outer panel 12, an inner panel 13 and conventional fiber type insulation 14 therebetween. Typically, panels 12, 13 are of relatively thin steel gauge construction, i.e. 18 gauge, and the insulation is conventional and similar to that used in industrial drying ovens and like constructions using "panel construction". Also, it should be noted that for ease of illustrating various mechanism employed within two panels 12, 13, no insulation in the cabinet or doors has been shown to be present adjacent the mechanism. Insulation is present in practice. The insulation is placed adjacent the levers or alternatively is applied as a layer of fibers packed into a thin "board" having the same insulation value as that of the other portions of the cabinet.

Cabinet 10 has an opening defined by a vertically extending left hand jamb 15, a vertically extending right hand jamb 16 and jambs 15, 16 are connected by top frame member 18 and bottom frame member 19. Jambs 15, 16 and frame members 18, 19 can be simply flat pieces or surfaces. However, the drawings show the surfaces of jambs 15, 16 and frame members 18, 19 to have an L shaped construction which the two panel doors nest into when they close. This recessed right angle construction of the opening provides a somewhat tortuous flame path which tends to restrict flames from seeping out or into cabinet 10 in the event of a fire. As best shown in FIG. 2, each frame member 18, 19 has a face surface 22 against which the door abuts and a flange lip surface 23 extending at right angles thereto. The jamb construction is similar (FIG. 6) and each jamb 15, 16 has a jamb face surface 25 and a jamb flange lip surface 26 extending at right angles thereto. Further, if cabinet 10 must be made air tight, a fire resistant fiber seal on lip surfaces 23, 26 circumscribing the opening can be provided. Cabinet 10 per se is conventional and the construction illustrated including the opening is typical. While a lip-flange opening is preferred given the two panel construction of the doors, other openings can be employed which do not use a lip. Further, in accordance with broader aspects of the invention, the cabinet and the door do not need to be a two panel construction and the term "cabinet" as used herein simply means an enclosure for containing materials having an opening which is to be closed by a door(s).

Access to cabinet 10 through its opening is provided by a two door arrangement comprising a left hand door 29 and a right hand door 30. The two door arrangement for the cabinet illustrated is preferred and specific features of the invention have been designed for use only with a two door arrangement. However, other aspects of the invention can function with a one door cabinet as will be explained hereafter.

Each door 29, 30 is secured to its respective jamb 15, 16 by conventional hinge 32 secured to jamb face surface 25 and to the inner edge of doors 29, 30 so that doors 29, 30 rotate from an open position as shown in FIG. 2 into a closed position as shown in FIG. 1. As noted above, it is essential to the invention that doors 29, 30 rotate from an open to a closed position to close the opening to cabinet 10 to avoid or minimize door closure problems which might be present from objects within cabinet 10 protruding beyond the face of cabinet 10. As noted, if a sliding door were used those objects would interfere with the door closing but would not interfere with doors which rotate into a closed position because the doors would simply push the objects back into the cabinet.

Figure 6:
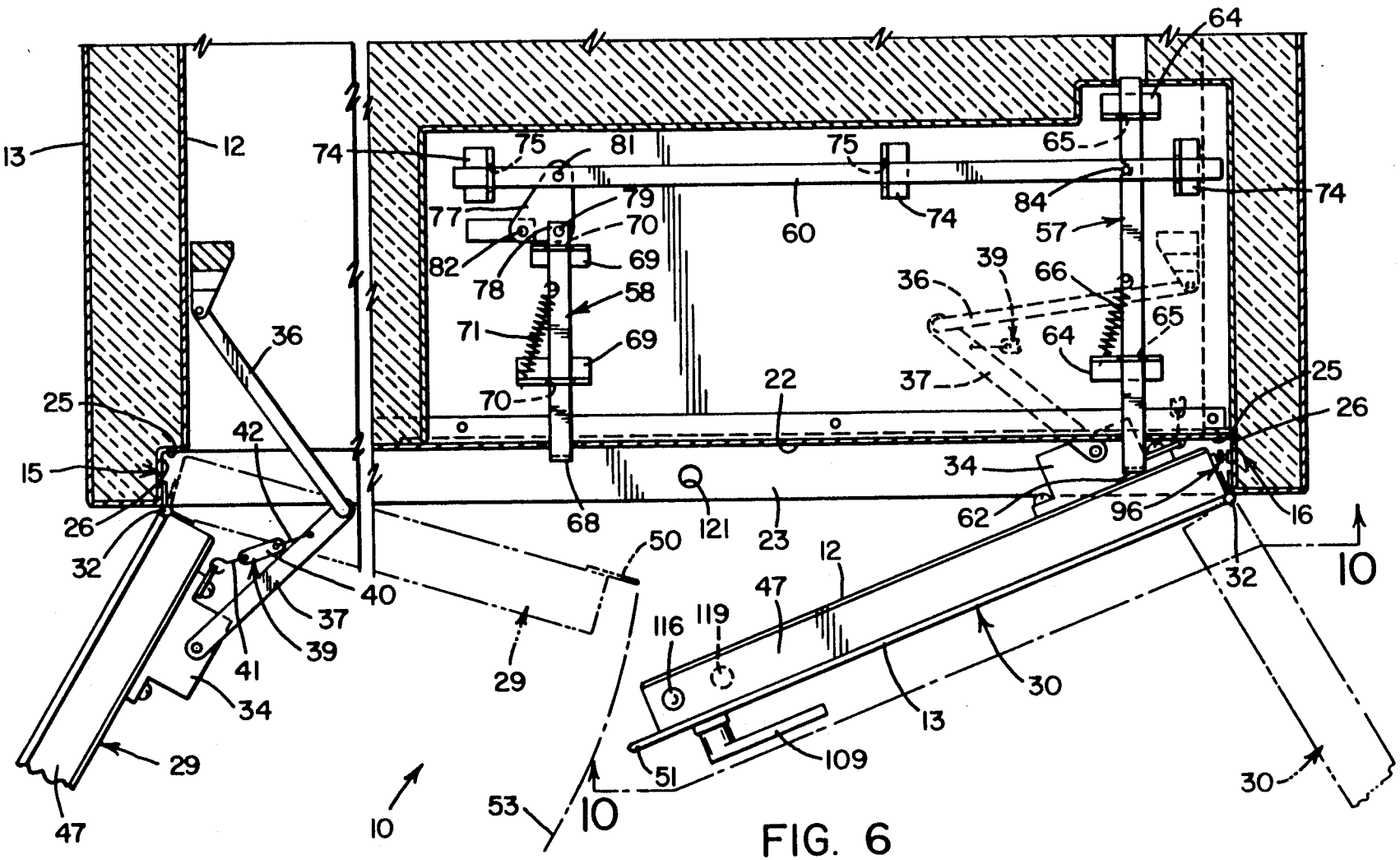
FIG. 6 is a top plan view of the door sequencing mechanism with the doors shown in an open position.

Referring now to FIGS. 2 and 6, attached to the inside panel of each door 29, 30 at one of the inside corners of the door is a door closure 34 which preferably is a conventional hydraulic door closure actuator. A conventional two link-three pivot mechanism is provided for closing the doors. The two link mechanism includes a cabinet link 36 pivoted at one of its ends to cabinet 10 and an actuator link 37 pivoted at one of its ends to door closure 34 while the opposite ends of links 36, 37 are pinned to one another. As already noted, links 36, 37 pull doors 29, 30 by the bias or rotational force exerted by door closure 34 on link 37 which is constant. The biasing closure force exerted by door closure is adjustable. To provide a temperature sensitive mechanism which can function to maintain doors 29, 30 in an open position and which, upon sensing a predetermined temperature would permit the doors to close vis-a-vis the biasing force from door closure 34, there is provided a fusible link 39 for each door closure 34. Fusible link 39 includes a temperture sensitive rigid metal section 40, one end of which is secured by means of door hook 41 to the inside panel of doors 29, 30 adjacent door closure 34 and the other end of which is connected through a link hook 42 to one of the links, 36, 37 of the door closure mechanism, specifically actuating link 37. When doors 29, 30 are open against the force of door closure 34, the doors can be latched against rotating into their closed position by simply attaching link hook 42 to actuating link 37. Fusible link 39 thus prevents the bias of door closure 34 from rotating the doors into their closed position by locking the linkage mechanism of door closure 34. Temperature sensitive section 40 is conventional and comprises any metal or any other material which upon exposure to any temperature in excess of a predetermined value, typically 140° F., will melt, disintegrate or snap. When temperature sensitive section 40 breaks, door closures 34 will then rotate the door to its closed position. Importantly, fusible links 39 are positioned adjacent to but outside cabinet 10. In this position, fusible link 39 will be actuated by either a fire external to cabinet 10 or by a fire originating within cabinet 10. Further, it should be noted that each door 29, 30 has its own fusible link 39 and thus each door is separately controlled. Both doors 29, 30 will not close until both fusible links 39 have melted.

Figure 5:
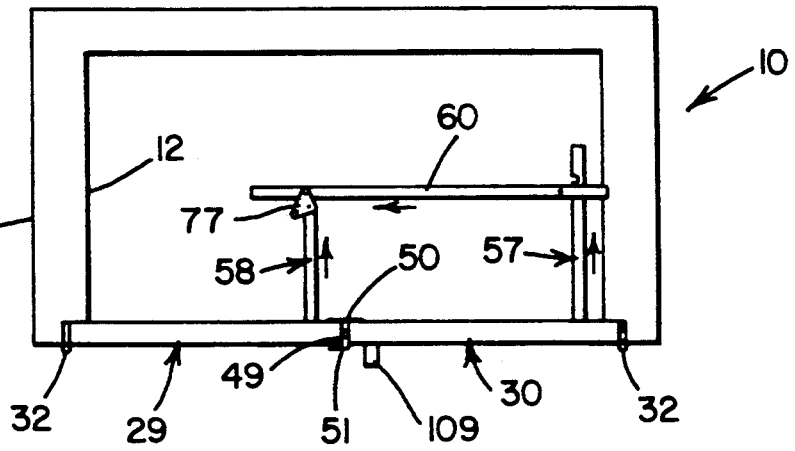
Figure 12:
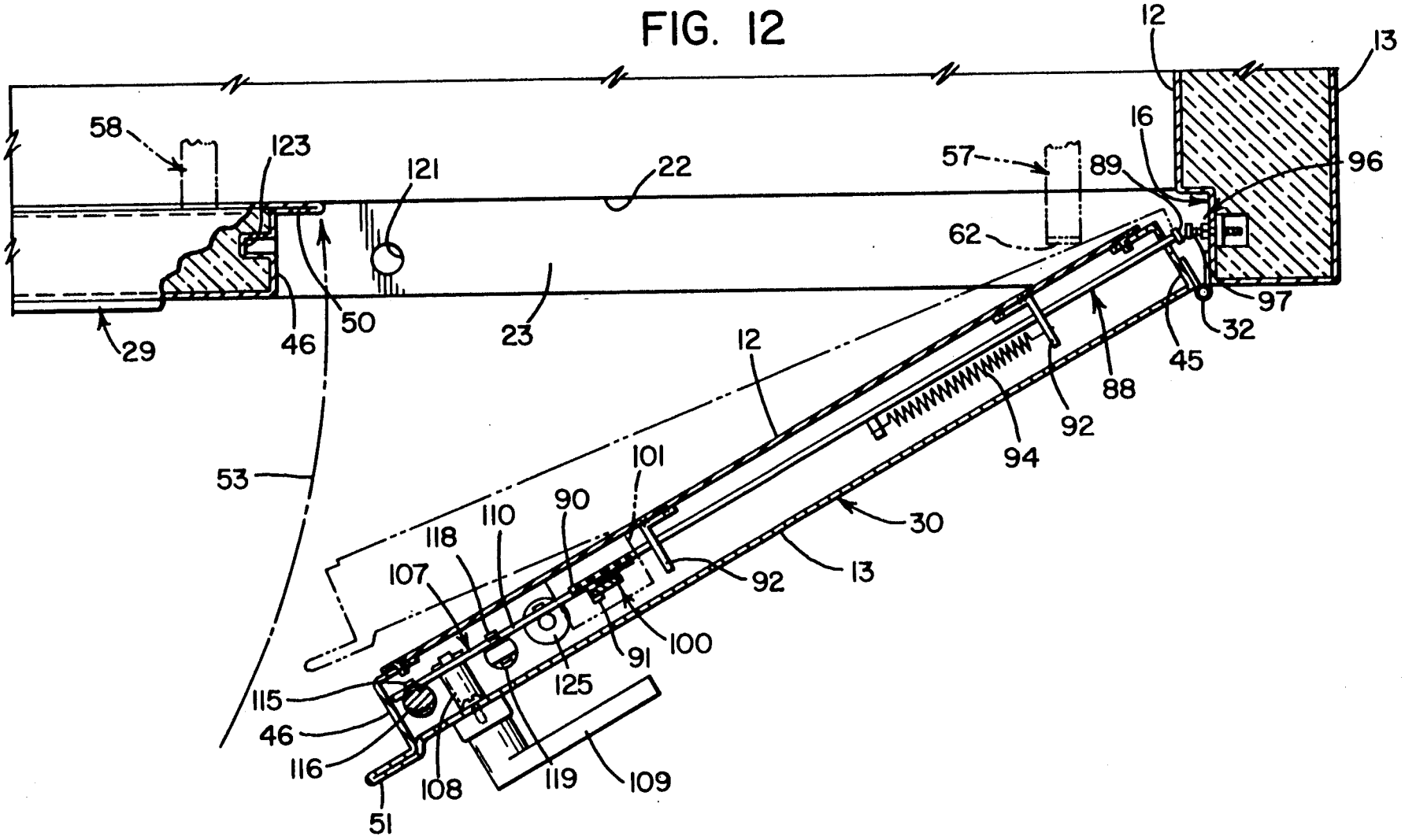
FIG. 12 is a top sectioned view of the latching mechanism taken along line 12—12 of FIG. 10.
Figure 13:
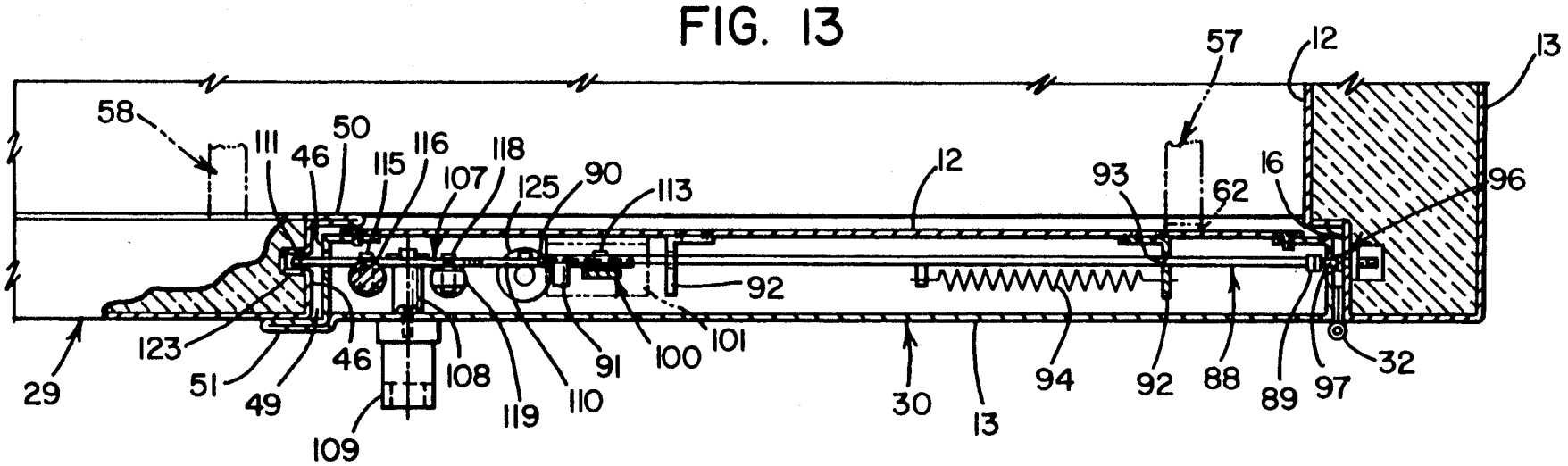
FIG. 13 is a top sectioned view of the latching mechanism of the invention taken along line 13—13 of FIG. 11.

Referring next to FIGS. 2 and 12, each door 29, 30 must have, by definition, a vertically extending hinge edge 45 adjacent jamb 15 or 16, a vertically extending outer edge 46, a top edge 47 and a bottom edge 48. Because doors 29, 30 have double panel 12, 13 construction, each edge 45–48 has a width or a distance of anywhere between about 1 to 1½ inches which is similar to the width of the panel construction used in cabinet 10. As best shown in FIGS. 5 and 13, when right and left hand doors 29, 30 are closed, there must by definition be a vertically extending gap 49 between vertically extending outer edges 46 of doors 29, 30. To prevent flames from entering into cabinet 10 or flames from leaving cabinet 10 through gap 49, a vertically extending inner lip 50 is provided to inner panel 13 of one of the doors, preferably left hand door 29. Also a vertically extending outer lip 51 can be applied to outer panel 13 of the opposite door, preferably right hand door 30. Lips 50, 51 have a sufficient width to close gap 49 so that when doors 29, 30 are in their closed position as shown in FIG. 5, lip 50 contacts inner panel 13 of right hand door 30 and lip 51 contacts outer panel 13 of left hand door 29. It should be noted that the door edge and lip construction provide the same tortuous path for the flame to follow which is present in the "L" shaped door opening described above. Also, a fiber seal can be attached to one of the lips 50, 51 to provide an airtight seal if the cabinet must be made airtight to positively prevent combustion.

Figure 3:
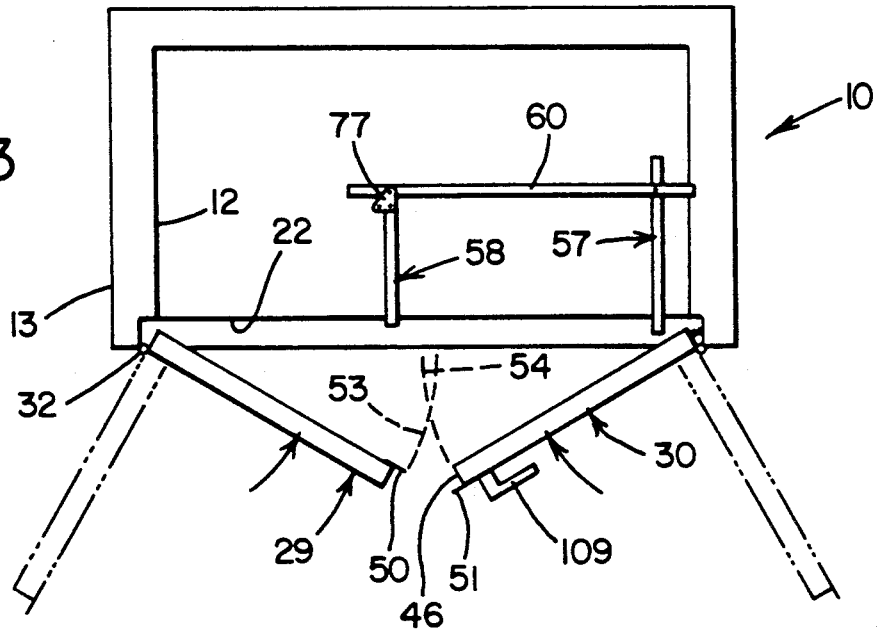
FIGS. 3, 4 and 5 are schematic, top plan views of the door sequencing mechanism used in the present invention.
Figure 4:
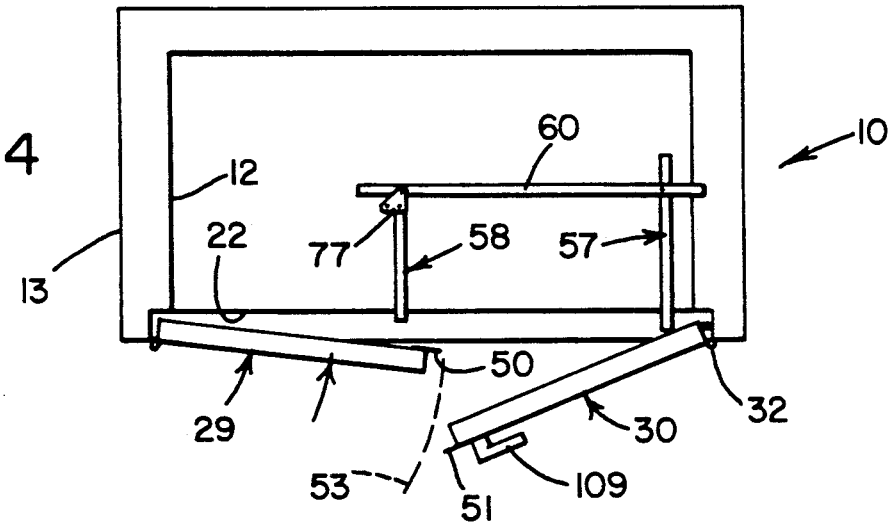

As best shown in FIGS. 3 and 4, since lips 50, 51 protrude beyond vertically extending outer edge 46 of doors 29, 30, an interference will develop between left hand door closure arc 53 and right hand door closure arc 54 (FIG. 3 shows the arcs as dash lines). This interference will prevent doors 29, 30 from rotating into their closed position if doors 29, 30 are simultaneously moved into their closed position or if right hand door 30 moves into its closed position prior to left hand door 29 rotating into its closed position. In the latter instance, lip 50 would contact outer panel 12 of right hand door 30. To prevent door interference from occurring, the present invention provides a door sequencing mechanism positioned either in the top wall of cabinet 10 adjacent top frame member 18 or, alternatively, in the bottom wall of cabinet 10 adjacent bottom frame member 19. Preferably, the door sequencing mechanism is positioned in the top wall of cabinet 10 adjacent top frame member 18 instead of at the bottom where protruding levers in the mechanism could be stepped on or present obstacles which the user must avoid. For definition purposes, doors 29, 30 are deemed to be in their closed position when inner panel 13 of doors 29, 30 contact or are closely adjacent to face surface 22 of top frame member 18.

As best shown in FIGS. 3, 4 and 5, the door sequencing mechanism includes a first lever 57 which protrudes beyond face surface 22 of top frame member 18 and is adapted to contact inner panel 13 of right hand door 30. A second lever 58 is also provided to extend or protrude beyond face surface 22 of top frame member 18 for contact with inner panel 13 of left hand door 29. An actuating link 60 interconnects first and second levers 57, 58 so that the movement of first lever 57 from its protruded position (FIGS. 3 and 4) to its retracted position (FIG. 5) is controlled by the movement of second lever 58 from its extended or protruded position whereat it extends beyond face surface 22 (FIGS. 3 and 4) to its retracted position whereat second lever 58 is coincident or generally flush with face surface 22. More specifically, FIG. 3 shows the door sequencing mechanism in its normal position, i.e. first and second levers 57, 58 extended with the doors open. Assuming that fusible link 39 on right hand door 30 melts first to release right hand door 30 for rotation to its closed position, then as shown in FIG. 4, right hand door 30 will rotate to contact first lever 57 in its protruded position. Because first lever 57 is locked against movement to its retracted position by actuating link 60, right hand door 30 is held open at some predetermined angle which is sufficient to permit left hand door with its lip 50 to rotate to a closed position without interfering with right hand door 30. Thus, when fusible link 39 for left hand door 29 melts, left hand door 29 will rotate as shown in FIG. 4 into contact with second lever 58. The bias of door closure 34 for left hand door 29 is sufficient to move second lever 58 to its retracted position as shown in FIG. 5 which in turn causes movement of actuating link 60 allowing door closure 34 for right hand door 30 to move first lever 57 to its retracted position.

Figure 7:
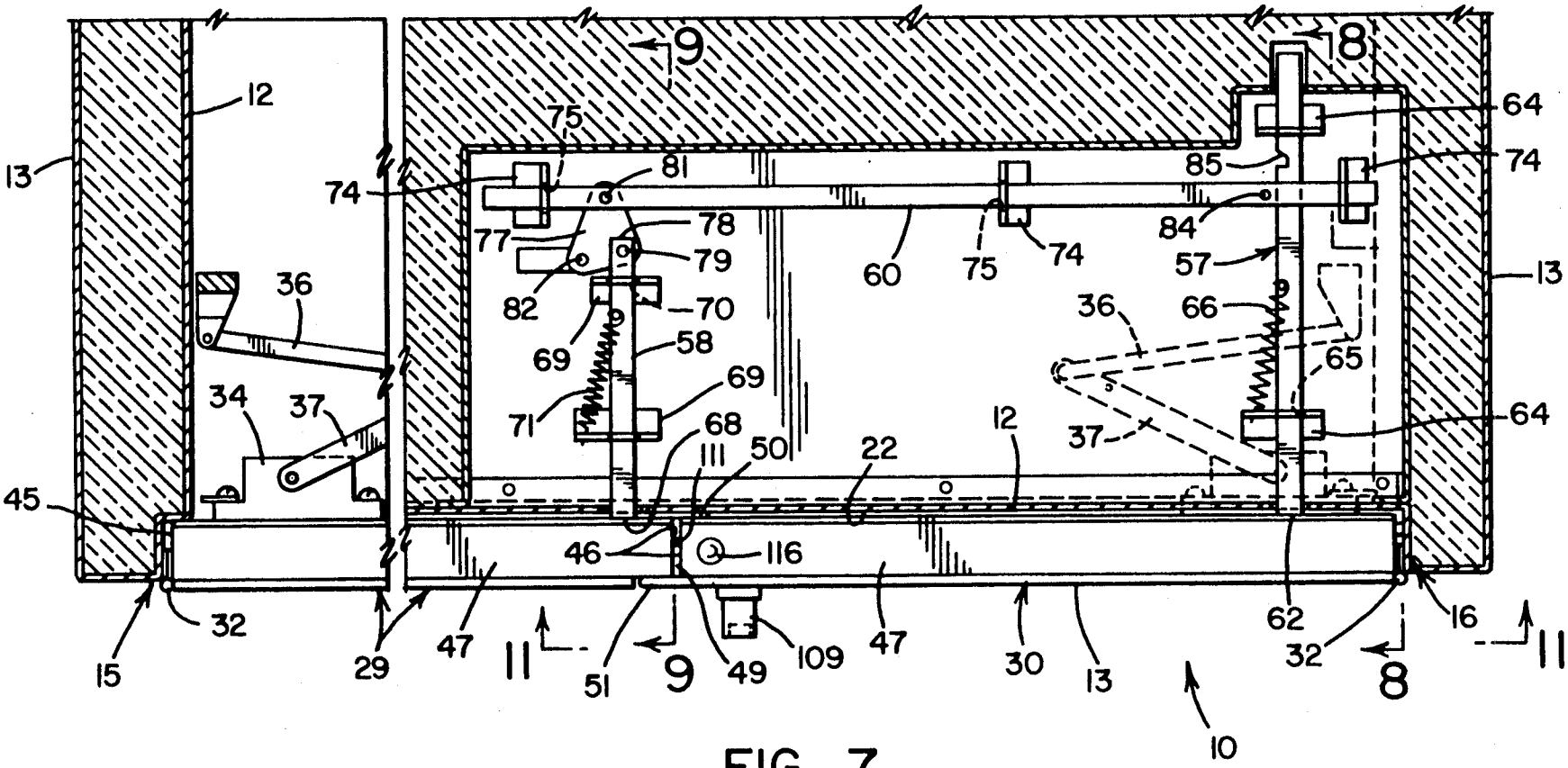
FIG. 7 is a view similar to FIG. 6 showing the door sequencing mechanism with the doors in a closed position.

The door sequencing mechanism is shown in detail in FIGS. 6 and 7 with FIG. 6 corresponding to the schematic shown in FIG. 4 and FIG. 7 corresponding to the schematic shown in FIG. 5. Referring to FIGS. 6 and 7, first lever 57 has a forward end 62 which as noted protrudes beyond face surface 22 of top frame member 18 in the extended position of first lever 57. Forward end 62 could be arcuately shaped for better contact with inner panel 13 of right hand door 30. First lever 57 moves in a direction generally perpendicular to face surface 22 and is controlled in its movement by guides 64 fixed to cabinet 10 and having slots 65 through which first lever 57 extends. A first lever spring 66 is secured to one of the first lever guides 64 and to first lever 57 to normally bias first lever 57 to position its forward end 62 in the protruded position of first lever 57 as described above. Similarly, second lever 58 has a forward end 68 which could be arcuately shaped for contact with left hand door 29 and is guided in its travel generally perpendicular to face surface 22 of frame member 18 by second lever guides 69 which are fixed to cabinet 10 and have slots 70 controlling travel direction of second lever 58. Second lever 58 similarly has a second lever spring 71 affixed between a second lever guide 69 and second lever 58 so that forward end 68 is normally biased by second lever spring 71 into its extended or protruded position. Actuating link 60 is positioned by actuating link guides 74 affixed to cabinet 10 having slots 75 of a predetermined width through which actuating link 60 extends and actuating link guides 74 with slot 75 are so positioned that actuating link 74 transversely extends and preferably extends in orthogonal relationship to first and second levers 57, 58.

Figure 9:
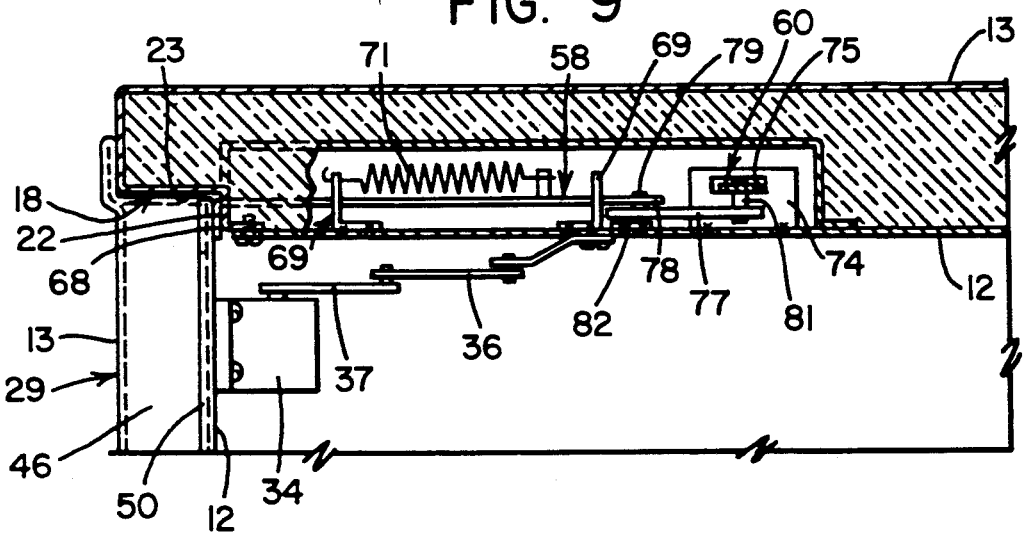

Referring now to FIGS. 6, 7 and 9, second lever 58 is connected to actuating link 60 by means of a bellcrank type of member 77 which in turn is connected to actuating link 60. More specifically, the rearward end 78 of second lever 58 is pivotally connected to bellcrank 77 by means of a second lever pin 79. Similarly, actuating link 60 is pivotally connected to bellcrank 77 by means of actuating link pin 81. Bellcrank 77 in turn rotates about a center of rotation pin 82 which in turn is affixed to cabinet 10, i.e. ground. When second lever 58 is moved to its retracted position, bellcrank 77 will rotate about center of rotation pin 82 and this in turn will cause connecting link 60 to move towards the left as viewed in FIGS. 6 and 7. It is appreciated that center of rotation pin 82 of bellcrank 77 is and must be off center with respect to second lever pin 79 and actuating link pin 81 and the slots 75 and 70 in guides 74 and 69 are widened relative to the width of actuating link 60 and second lever 58 to permit bellcrank 77 to rotate without binding second lever 58 or connecting link 60 in their guides. Alternatively, a more complicated pin-arcuate slot or track arrangement can be used to account for arcuate rotation of pins 79, 81.

Figure 8:
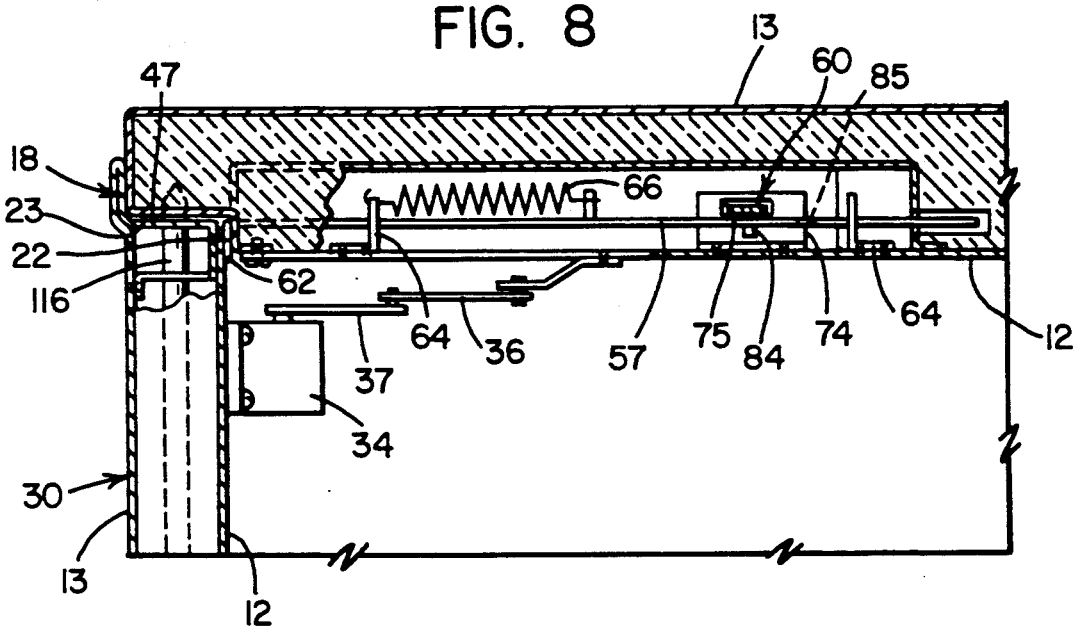
FIGS. 8 and 9 are sectioned elevation views of the door closing mechanism taken along lines 8—8 and 9—9, respectively, as shown in FIG. 7.

Referring now to FIGS. 6, 7 and 8, actuating link 60 has a fixed pin 84 depending from one side thereof and first lever 57 has a slot 85 formed in its edge adjacent pin 84. Slot 85 preferably has the configuration as shown in FIG. 7 although other slot configurations are possible. With first and second levers 57, 58 in their protruded position which result from the bias of springs 66, 71 pin 84 is positioned in slot 85 as shown in FIG. 6. When right hand door contacts forward end 62 of first lever 57, movement of first lever 57 to its retracted position is impossible because of the pin slot connection 84, 85. When left hand door contacts forward end 68 of second lever 58 and moves second lever 58 to its retracted position, bellcrank 77 will rotate about center of rotation pin 82 and cause actuating link 60 to pull pin 84 from slot 85. With the pin connection removed, door closure 34 on right hand door 30 will force first lever 57 against the biasing force of first lever spring 66 to its retracted position.

Figure 10:
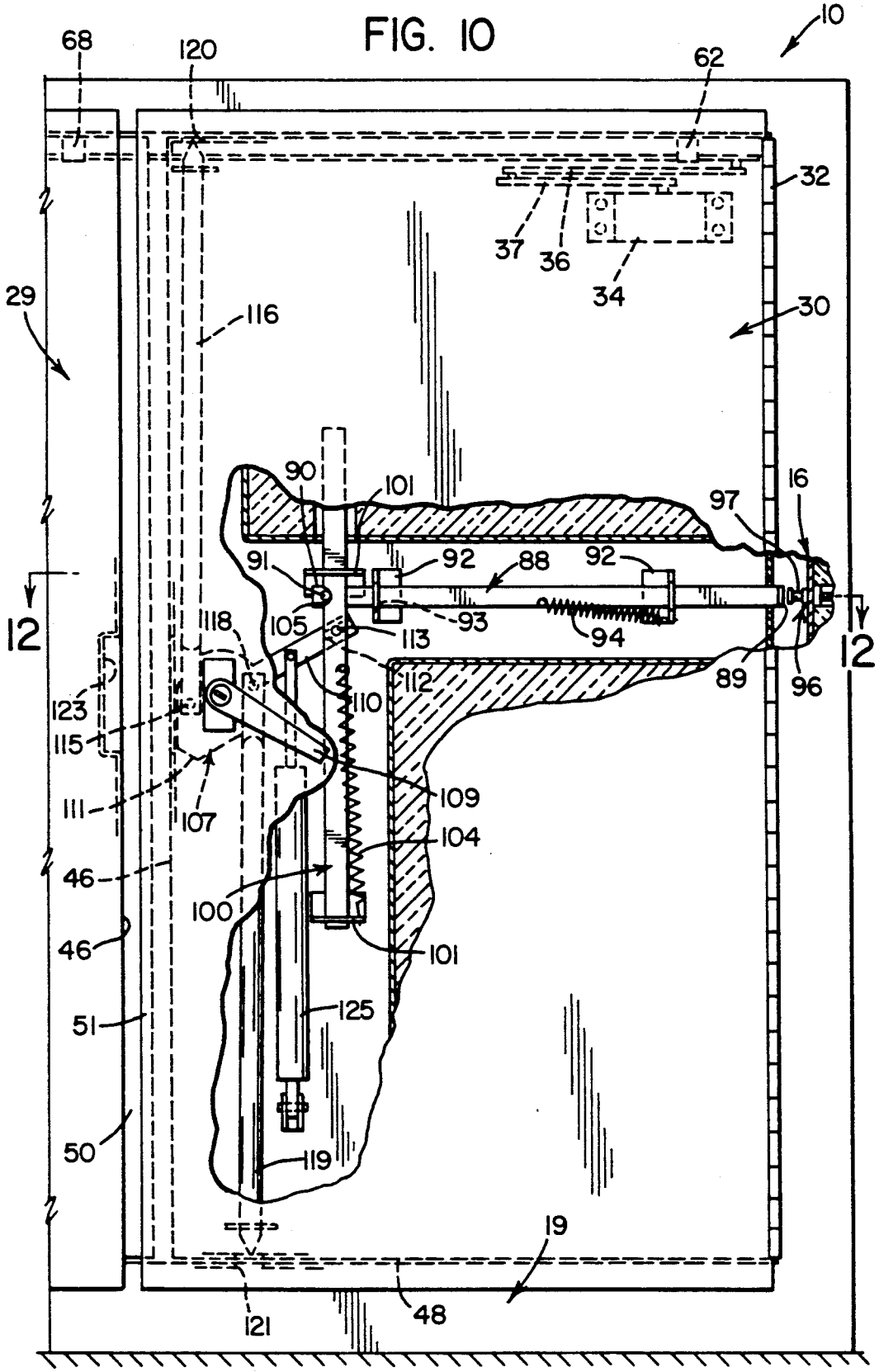
FIG. 10 is an elevation view of the right hand door with portions of the door broken away to show the latching mechanism of the invention taken along lines 10—10 of FIG. 6.
Figure 11:
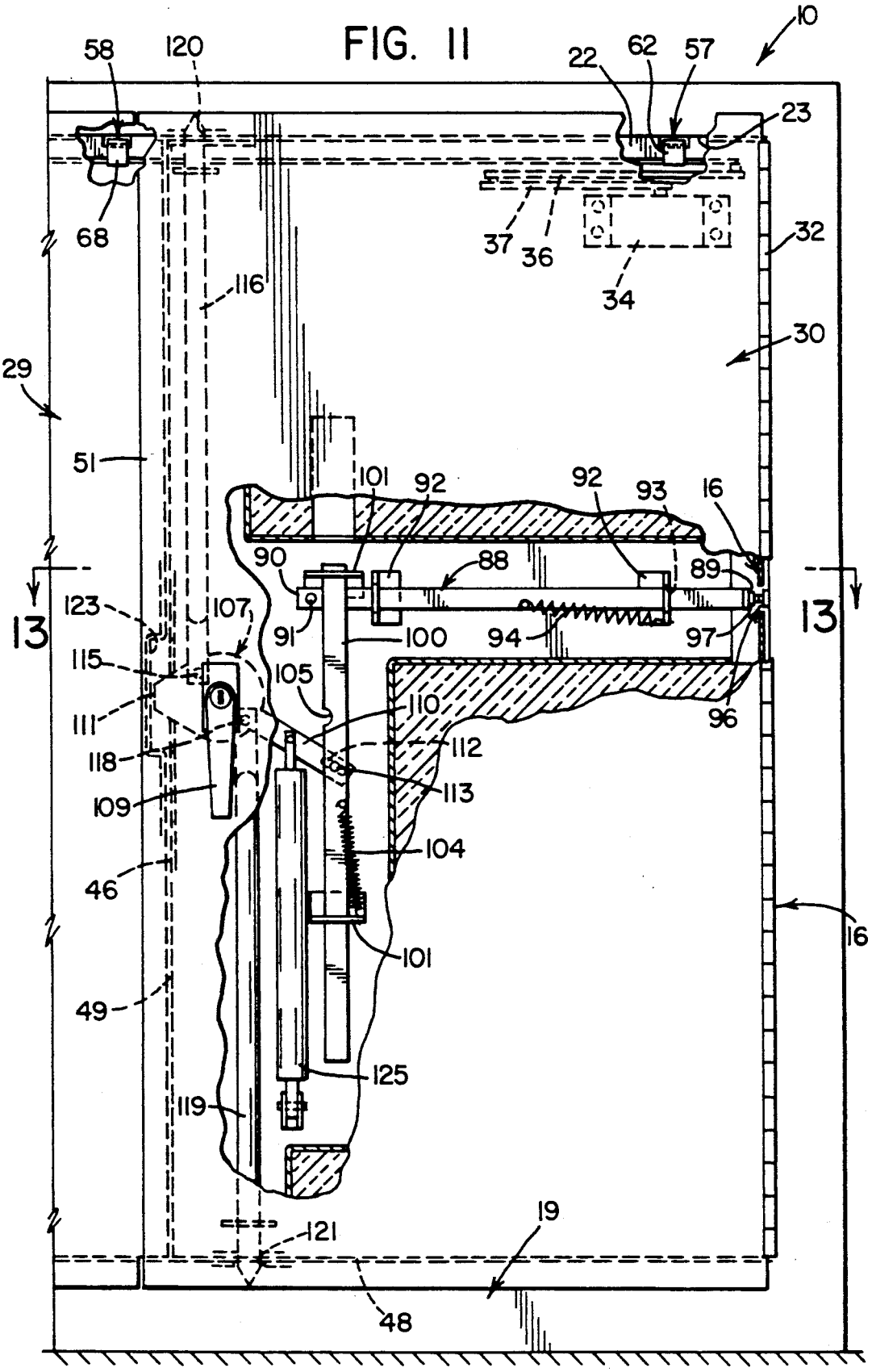
FIG. 11 is a view similar to FIG. 6 but showing the latching mechanism in the latched position.

Referring now to FIGS. 10–13, the self-latching or automatic locking mechanism of the invention will be described. Functionally, the self-latching mechanism provides for the doors to be positively and securely locked automatically on door closure but retains an override provision so that the doors can be manually unlocked and opened. The self-latching mechanism is shown in its unlocked or unlatched position in FIG. 10 and in its locked or latched position in FIG. 11. The self-latching mechanism includes an actuating lever 88 which has an inner end 89 adapted to contact jamb 16 and an outer end 90 adapted to lock and unlock the self-latching mechanism. Controlling the direction and movement of actuating lever 88 are guides 92 fixed to right hand door 30 and having slots 93. An actuating lever spring 94 affixed to actuating lever 88 and one of actuating lever guides 92 biases actuating lever 88 to its locked position which is shown in FIG. 10. Upon door closure, actuating lever 88 moves against the bias of actuating lever spring 94 to its unlocked position which is shown in FIG. 11. To provide for positive actuation of actuating lever 88 and to adjust the tension or action of the self-latching mechanism, inner end 89 of actuating lever 88 contacts an axially adjustable door jamb stop 96. Rotation of the threaded stud 97 of door jamb stop 96 adjusts the tension of actuating lever spring 94 and varies the travel of actuating lever 88 within guides 92 resulting from door rotation.

Cooperating with actuating lever 88 is positioning lever 100. Positioning lever 100 is guided in its direction of motion by guides 101 which are fixed to right hand door 30 and which have slots through which positioning lever 100 extends. Positioning lever spring 104 secured to positioning lever 100 and one of its guides 101 biases positioning lever 100 to its unlocked position which is shown in FIG. 11. The locked position of positioning lever 100 is shown in FIG. 10 and is against the bias of positioning spring 104. A positioning lever slot 105 is formed at one edge of positioning lever 100 and positioning lever slot 105 acts in conjunction with a locking pin 91 extending adjacent to outer end 90 of actuating lever 88. Actuating lever pin 91 engages positioning lever slot 105 when actuating lever 88 and positioning lever 100 are in their locked position (FIG. 10) and positioning lever spring 104 is not effective to disengage positioning lever 100 from actuating lever 88 vis-a-vis the pin slot 91–105 connection. When right hand door 30 rotates to its closed position, actuating lever 88 moves against the bias of actuating lever spring 94 so that actuating locking pin 91 disengages itself from positioning lever slot 105 at which time positioning lever spring 104 moves positioning lever 100 downward toward bottom frame member 19 to positioning lever 100's unlocked position as shown in FIG. 11.

Movement of positioning lever 100 controls the door latch mechanism. Door latch mechanism includes a bellcrank 107 which is mounted for rotation about a center post 108 fixed to right hand door 30 as best shown in FIGS. 12 and 13, and to which a handle 109 is attached so that rotation of handle 109 causes bellcrank 107 to rotate about center post 108. Bellcrank 107 has an actuating arm portion 110 which extends to and overlies positioning lever 100. Actuating arm portion has a slot 112 and a positioning lever pin 113 extends from positioning lever 100 and into actuating arm slot 112 so that movement of positioning lever 100 will cause rotation of bellcrank 107 and vice versa. Pinned in a pivotal manner on one side of bellcrank center post 108 as at 115 is a top locking rod 116. Similarly, pinned in a pivotal manner on the other side of center post 108 as at 118 is a bottom locking rod 119. When positioning lever 100 is in its unlocked position, actuating arm portion 110 has caused bellcrank 107 to rotate about center post 108 to a position whereat top locking rod 116 extends into and is latched within a top latch slot 120 formed in lip surface 23 of top frame member 18. Similarly, bottom locking rod 119 protrudes beyond bottom edge 48 of right hand door 30 and extends into a bottom latching slot 121 formed in lip surface 23 of bottom frame member 19. Additionally, bellcrank 107 has a tongue portion 111 which extends beyond vertically extending outer edge 46 of right hand door 30 in the position shown in FIG. 11 to engage a door slot 123 formed in vertically extending outer edge 46 of left hand door 29. Thus, there are three solid lock points for right hand door 30, i.e. top latching rod 116, bottom latching rod 119 and tongue portion 111. These points positively lock left hand door 29 to right hand door 30 vis-a-vis tongue portion 111 and right hand door 30 is positively locked to cabinet 10 vis-a-vis top and bottom latch rods 116, 121. Appropriate strengthening of all latch points in cabinet 10 and left hand door 29 can be made to insure that the opening to cabinet 10 will not be uncovered even if combustible material within the cabinet were to explode from the heat or the flames of the fire. Also, it should be noted that insofar as the self-latching-manual override mechanism is concerned, there does not need to be two doors for the mechanism, as described, to function. That is, the mechanism will work as thus far described if only right hand door 30 were used to close the opening in cabinet 10. The left hand jamb 15 would be modified to include door slot 123 and the door sequencing mechanism would not be utilized. Fusible link 39 and door closure 35 would be attached exactly as shown. Cabinet 10 would then have a rotatable one door closure which would automatically close in the event of a fire and which, upon closing would automatically and positively lock itself for the reasons described. For a number of reasons, however, a two door arrangement is desired for cabinet 10 and the invention was specifically developed for a two door arrangement.

To open cabinet 10 manually, handle 109 is rotated so that actuating arm portion 110 moves positioning lever 100 vis-a-vis slot-pin connection 112–113 against the biasing force of positioning lever spring 104 to its locked position (FIG. 10). This movement is possible because actuating lever 88 is in its unlocked position (FIG. 11) vis-a-vis contact with jamb stop 96, thus moving actuating pin 91 out of contact with positioning lever slot 105. With handle 109 thus rotated, right hand door 30 is pulled against the force of door closure 34 and rotated to its open position whereat actuation lever spring 94 causes actuating lever pin 91 to engage positioning lever slot 105 (FIG. 10) to secure the latching mechanism in its unlocked position. Thus, the door closing mechanism is provided with a manual override feature so that doors 29, 30 can be manually,opened.

It should be noted that in the two door arrangement described thus far, the door sequencing mechanism is actuated prior to the automatic locking mechanism being actuated. When the door sequencing mechanism is holding right hand door 30 in a partially closed position, actuating lever 88 is very close to starting its movement to unlock the slot pin connection with positioning lever 100. In fact, it is possible for latching actuation to start before first lever 54 has allowed right hand door 30 to completely close against face surface 22 of top frame member 18. To delay the actuation of the automatic self-latching mechanism and to insure contact of right hand door 30 with face surface 22 of top frame member 18, a dampener 125, preferably hydraulic, is pinned to actuating arm portion 110 to dampen or slow the movement of positioning lever slot 105 from its locked to its unlocked position. This prevents top locking rod 116, bottom locking rod 119 and tongue portion 111 from protruding beyond the door edges prior to right hand door 30 rotating into its fully closed position.

The invention has been described with reference to a preferred embodiment. Specifically, the invention has been described with reference to a multiple two door closure arrangement for a paint cabinet or enclosure for holding combustible materials which, in the event of a fire, will automatically sequence the closing of the doors and provide automatic locking thereof in the event of a fire. As already noted, the door sequencing mechanism could be alleviated if a one door arrangement were used. Alternatively, the door sequencing mechanism could be used in any two door closure for any purpose where one door had to be closed prior to the closing of another door and without regard to the self-locking mechanism. Further, the invention has been shown with respect to the right hand door containing self-locking mechanism. This is obviously relative and the doors could easily be reversed. Insofar as the door sequencing is concerned, it should be apparent from FIGS. 3–5 that the door to which inner lip 50 is attached must be closed first and this determines the position of first and second levers 57, 58. When the automatic latching mechanism is used, inner lip 50 must be applied to the door which does not contain the latching mechanism. It is intended to include all such modifications and alterations insofar as they come within the scope of the present invention.

It is thus the essence of the invention to provide a door closure arrangement which utilizes a unique door sequencing arrangement for rotating the doors into a closed position and a unique automatic self-latching mechanism for locking the doors, the combination of which has particular application with respect to cabinets and the like containing combustible materials such as solvent based paints where the fire hazard requires the combustible materials to be sealed from its surroundings in the event of a fire inside or outside of the container.

Having thus defined the invention, the following is claimed:

1. A door arrangement for a safety cabinet adapted to store paint and similar combustible materials, said cabinet having an opening defined by right and left hand jambs and a top and bottom frame extending therebetween, said arrangement comprising:

a first door and a second door;

hinge means at each joint for pivotally connecting said first door to one jamb and said second door to the other one of said jambs and permitting said doors to rotate from a closed position whereat said doors cover said cabinet's opening to an open position whereat said doors pivot adjacent to said jambs to allow access to said cabinet through said opening;

door closure means affixed to each door for biasing each door into its closed position;

temperature sensing means associated with said door closure means and operable to maintain said doors in their open position against the bias of said closure means until a predetermined temperature is sensed whereat said temperature sensing means permit said door closure means to close said doors;

door sequencing means operable against the bias of said door closure means to permit one of said doors to close prior to the other door;

self-latching means operable when said doors are in their closed position to automatically latch said door to said cabinet;

said self-latching means includes in said first door a door actuating lever;

stop means associated with said actuating lever and said jamb at which said first door is hinged for moving said actuating lever with respect to said first door from a locked position when said first door is opened to an unlocked position when said first door is closed;

door actuating lever spring means biasing said actuating lever towards its locked position;

a positioning lever adjacent to said door actuating lever; positioning lever guide means permitting said positioning lever to move with respect to said first door from a locked position when said first door is in its opened position to an unlocked position when said first door is in its closed position;

positioning lever spring means biasing said positioning lever to its unlocked position;

locking and unlocking means associated with said levers for locking said levers when in a locked position and actuated, upon movement of said actuating lever by said stop means, for unlocking said levers when in their unlocked positions; and door latch means operably connected to said positioning lever for automatically latching said first door to at least one of said frame members when said first door is in its closed position.

2. The door arrangement of claim 1 wherein said second door has a sealing lip vertically extending from its vertical edge opposite its edge adjacent said jamb, and said door sequencing means permits said second door to close prior to said first door closing;

said sequencing means is associated with one of said cabinet frame members and includes i) a first lever having a protruded position whereat a contact end of said first lever extends beyond the face of one of said frame members for contacting said first door and preventing rotating thereof into a closed position and a retracted position whereat said contact end is substantially coincident with the face of said one frame member when said first door is in a closed position; ii) a second lever having a protruded position whereat a contact end of said second lever extends beyond the face of said one frame member for contacting said second door prior to closure thereof and a retracted position whereat said contact end of said second lever is substantially coincident with said face of said one frame member when said second door is in a closed position and iii) actuating link means permitting said first lever to move from its protruded position to its retracted position when said second lever has moved to its retracted position.

3. The door arrangement of claim 1 wherein said door latch means includes a door bellcrank rotatable about a pivot point between a latched and unlatched position; an arm extending from said bellcrank and pinned to said positioning lever so that said bellcrank rotates about its pivot point when said first door moves from one position to another; a top latch rod pivotally pinned on one side of said bellcrank's pivot and a bottom latch rod pivotally pinned on the opposite side of said pivot, said latch members movable into and out of locking engagement with said frame members upon rotation of said bellcrank.

4. The door arrangement of claim 3 further including dampener means attached to said bellcrank arm and operable to delay movement of said latch rods when said positioning lever spring means is operable to move to said positioning lever to its unlocked position whereby said first door is assured of being latched only after said first door has reached its closed position.

5. The door arrangement of claim 4 wherein said bellcrank has a tongue portion extending therefrom and protruding beyond the edge of said door when said bellcrank is rotated into its locked position to provide an additional latching point for securing said doors in a closed position with said cabinet.

6. The door arrangement of claim 5 wherein said first door has a handle affixed to said pivot which is manually operable to rotate said door bellcrank about its pivot against the bias of said positioning lever spring means for unlatching said rods and said tongue from their latched position and permitting manual rotation of said first door from its closed, locked position to its open position.

7. The door arrangement of claim 1 wherein said door actuating lever guide means and said positioning lever guide permit generally orthogonal movement of said door actuating lever and said positioning lever relative to one another; said locking and unlocking means including a pin affixed to one of said levers, a notch formed on the other lever adjacent said pin and said pin engaged in said notch when said actuating lever and said positioning lever are in locked positions.

8. The door arrangement of claim 7 wherein said actuating lever has an inward end adjacent to said jamb; said stop means contacting said outward end when said door is closed and moving said actuating lever from its locked to its unlocked position, and adjustment means operable to vary the travel of said adjusting lever spring when said first door rotates from its open to its closed position.

9. The door arrangement of claim 2 further including first lever guide means controlling movement direction of said first lever from its protruded position to its retracted position; first spring means for biasing said first lever into its protruded position; and said actuating link means including an actuating link having a pin extending therefrom, said first lever having a notch formed in one side therefore, said pin engaging said notch to prevent movement of said first lever when said second lever is in its protruded position.

10. The door arrangement of claim 9 further including second lever guide means for controlling the movement direction of said second lever from its protruded position to its retracted position; second lever spring means for biasing said second lever to its protruded position and said actuating link means further including a second lever bellcrank pinned to said actuating link and rotatable upon movement of said second lever from its protruded position to its retracted position to move said actuating link and said actuating link pin from said notch of said first lever whereby said door closure means overcomes said first lever's spring means bias and causes said first door to rotate to a closed position.

11. The door arrangement of claim 10 further including actuating link guide means for controlling movement direction of said actuating link, said movement direction of said first and second levers generally parallel with one another, and said movement direction of said actuating link being transverse to that of said first and second levers.

12. A door arrangement for a safety cabinet adapted to store paint and similar combustible materials, said cabinet having an opening defined by right and left hand jambs and a top and bottom frame extending therebetween, said arrangement comprising:

a first door and a second door;

hinge means at each joint for pivotally connecting said first door to one jamb and said second door to the other one of said jambs and permitting said doors to rotate from a closed position whereat said doors cover said cabinet's opening to an open position whereat said doors pivot adjacent to said jambs to allow access to said cabinet through said opening;

at least one of said doors has a sealing lip extending from and contiguous with its vertical edge opposite its edge adjacent one of said jambs and adapted to close the opening between said doors when said doors are in a closed position;

door closure means affixed to each door for biasing each door into its closed position;

temperature sensing means associated with said door closure means and operable to maintain said doors in their open position against the bias of said closure means until a predetermined temperature is sensed whereat said temperature sensing means permit said door closure means to close said doors;

door sequencing means operable against the bias of said door closure means to permit one of said doors to close prior to the other door whereby automatic closure of said doors always occurs without interference from said lip;

said second door having said sealing lip and said door sequencing means permitting said second door to close prior to said first door closing;

said sequencing means being associated with one of said cabinet frame members and including i) a first lever having a protruded position whereat a contact end of said first lever extends beyond the face of said one frame member for contacting said first door and preventing rotating thereof into a closed position and a retracted position whereat said contact end is substantially coincident with said face of said one frame member when said first door is in a closed position; ii) a second lever having a protruded position whereat a contact end of said second lever extends beyond the face of said one frame member for contacting said second door prior to closure thereof and a retracted position whereat said contact end of said second lever is substantially coincident with said face of said one frame member when said second door is in a closed position and iii) actuating link means permitting said first lever to move from its protruded position to its retracted position when said second lever has moved to its retracted position;

first lever guide means controlling movement direction of said first lever from its protruded position to its retracted position;

first spring means for biasing said first lever into its protruded position; and said actuating link means including an actuating link having a pin extending therefrom, said first lever having a notch formed in one side therefore, said pin engaging said notch to prevent movement of said first lever when said second lever is in its protruded position.

13. The door arrangement of claim 12 further including second lever guide means for controlling the movement direction of said second lever from its protruded position to its retracted position; second lever spring means for biasing said second lever to its protruded position and said actuating link means further including a second lever bellcrank pinned to said actuating link and rotatable upon movement of said second lever from its protruded position to its retracted position to move said actuating link and said actuating link pin from said notch of said first lever whereby said door closure means overcomes said first lever's spring means bias and causes said first door to rotate to a closed position.

14. The door arrangement of claim 13 further including actuating link guide means for controlling movement direction of said actuating link, said movement direction of said first and second levers generally parallel with one another, and said movement direction of said actuating link being transverse to that of said first and second levers.

15. A cabinet comprising left and right hand vertically extending jambs and top and bottom frame members extending between said jambs to define an opening therein; a door pivotally mounted to one of said jambs for rotating from a closed position whereat at least a portion of said opening is closed to an open position whereat access to said cabinet can be had through said opening; self-latching mean for automatically locking said door to said opening when said door is rotated from its open to its closed position, said self-latching means including a door actuating lever, actuating lever guide means permitting said actuating lever to move with respect to said door, stop means associated with said actuating lever for moving said actuating lever from a locked position when said door is opened to an unlocked position when said door is closed, actuating lever spring means biasing said actuating lever to its locked position; a positioning lever adjacent to said door actuating lever; positioning lever guide means permitting said positioning lever to move with respect to said door; positioning lever spring means biasing said positioning lever from a locked position when said door is opened to an unlocked position when said door is closed; means associated with said levers for locking said positioning lever to said actuating lever when said door is opened and unlocking said levers when stop means moves said actuating lever upon door rotation to its closed position; and door latch means operably connected to said positioning lever for automatically latching said door to at least one of said frame members when said door is in its closed position.

16. The cabinet of claim 15 wherein said door latch means includes a door bellcrank rotatable about a pivot point between a latched and unlatched position; an arm extending from said bellcrank and pinned to said positioning lever so that said bellcrank rotates about its pivot point when said first door moves from one position to another; a top latch rod pivotally pinned on one side of said bellcrank's pivot and a bottom latch rod pivotally pinned on the opposite side of said pivot, said latch members movable into and out of locking engagement with said frame members upon rotation of said bellcrank.

17. The cabinet of claim 16 further including dampener means attached to said bellcrank arm and operable to delay movement of said latch rods when said positioning lever spring means is operable to move to said positioning lever to its unlocked position whereby said door is assured of being latched only after said first door has reached its closed position.

18. The cabinet of claim 17 wherein said bellcrank has a tongue portion extending therefrom and protruding beyond the edge of said door when said bellcrank is rotated into its locked position to provide an additional latching point for securing said doors in a closed position with said cabinet.

19. The cabinet of claim 18 wherein said door has a handle affixed to said pivot which is manually operable to rotate said door bellcrank about its pivot against the bias of said positioning lever spring means for unlatching said rods and said tongue from their latched position and permitting rotation of said first door from its closed, locked position to its open position.

20. The cabinet of claim 15 wherein said door actuating lever guide means and said positioning lever guide means permits generally orthogonal movement of said door actuating lever and said positioning lever relative to one another; said locking and unlocking means includes a pin affixed to either said actuating lever or said positioning lever, a notch formed in the other lever, and said pin engaged in said notch when said actuating lever and said positioning lever are in locked positions.

21. The cabinet of claim 15 wherein said actuating lever has an an inward end adjacent to said jamb; said stop means associated with said jamb for contacting said inward end of said actuating lever with said jamb as said door closes to move said actuating lever from its locked to its unlocked position; and adjustment means on said actuating lever for varying the position of said inward end relative to said jamb whereby the automatic latching of the door can be adjusted.

22. The cabinet of claim 20 further including a second door hinged to the jamb opposite to which said first door is hinged; said second door having a vertically extending lip protruding from the vertical edge of said second door adjacent to said first door, said lip closing the space between said first and second doors when said doors are in their closed position; said tongue portion contacting said lip when said first door is latched thus latching said second door and door closure means attached to said first and second doors for rotating said first and second doors into their closed positions.

23. An automatic door closing and latching arrangement for a cabinet storing paint and like combustible materials, said cabinet having an opening defined by left hand and right hand vertically extending jambs and top and bottom frame members extending therebetween, said door arrangement comprising:

a first door hinged at one jamb and a second door hinged at an opposite jamb so that said doors are rotatable from a closed position generally flush with said cabinet to an open position where access to said opening can be had, said second door has a vertically extending lip protruding beyond its vertical edge opposite said hinge end for closing the space between said doors when said doors are in their closed position;

door closure means constantly biasing both doors to rotate from their open to their closed position and including temperature sensing means holding said doors in an open position against said bias and automatically releasing said holding when a predetermined temperature is sensed;

door sequencing means operable to prevent said first door from closing until said second door has closed;

door self-latching means in said first door operable upon closing of said first door to latch said first door to said top and bottom frame members and to said second door whereby both of said doors are securely latched and said lip prevents any flame originating from the contents of the cabinet to pass through the opening between the doors;

said door self-latching means includes in said first door, a spring loaded door actuating lever movable with respect to said first door during the closing of said first door by first door contact with said jamb associated with said first door from a locked to an unlocked position;

a spring loaded positioning lever operably connected to said actuating lever and movable from a locked to an unlocked position when said actuating lever moves from a locked to an unlocked position;

door latching means in said first door pivotably connected to said positioning lever and including at least one rod, a bell crank connected to said one rod and said positioning lever and rotatable to cause said one rod to move from within said first door to protrude out of said first door for locking both doors against opening when said positioning lever moves from its locked to its unlocked position and;

means to lock the positioning and actuating levers during the opening of said first door from the closed position and unlocking said levers by movement of said actuating lever when said first door rotates from its open to its closed position.

24. In a safety cabinet having a fusible link door arrangement in which the doors are hinged at one end and automatically rotate by door closures into a closed position when the fusible link melts and a sequencing mechanism is used to assure that one door closes before the other, the improvement comprising:

i) a spring biased first lever having a protruded position whereat a contact end of said first lever extends beyond the face of cabinet for contacting one of said doors and preventing rotation thereof into a closed position and a retracted position whereat said contact end is at least coincident with the face of said cabinet when said one of said doors is in a closed position; ii) a spring biased second lever having a protruded position whereat a contact end of said second lever extends beyond the face of said cabinet for contacting the other door prior to closure thereof and a retracted position whereat said contact end of said second lever is at least coincident with said face of said cabinet when said other door is in a closed position and iii) actuating link means allowing said first lever to move from its protruded position to its retracted position only when said second lever has moved to its retracted position, said actuating link means including an actuating link extending between said first and second levers, pin-notch connecting means formed between said actuating link and said first lever whereby a pin on one of said link and said first lever is positioned within a slot on the other one of said first lever and said link to prevent movement of said first lever, and a bellcrank, pinned to said second lever and said actuating link and rotatable upon movement of said second lever from its protruded to its retracted position, for moving said actuating link so that said pin moves from said notch to permit said first lever to move to its retracted position.

25. The cabinet of claim 24 further including actuating link guide means for controlling movement direction of said actuating link, said movement direction of said first and second levers generally parallel with one another, and said movement direction of said actuating link being transverse to that of said first and second levers.

* * * * *